US008323163B2

(12) United States Patent
Asai

(10) Patent No.: US 8,323,163 B2
(45) Date of Patent: Dec. 4, 2012

(54) POSITIONING-JIG FOR ADJUSTING A FACE PLATE

(75) Inventor: Kazuaki Asai, Kanazawa (JP)

(73) Assignees: Kazuhisa Futaya, Kizugawa-Shi (JP); Make A Box Co., Ltd., Kanazawa-Shi (JP)

( * ) Notice: Subject to any disclaimer, the term of this patent is extended or adjusted under 35 U.S.C. 154(b) by 407 days.

(21) Appl. No.: 12/656,377

(22) Filed: Jan. 28, 2010

(65) Prior Publication Data

US 2010/0190625 A1 Jul. 29, 2010

(30) Foreign Application Priority Data

Jan. 29, 2009 (JP) ..... 2009-017607

(51) Int. Cl.
*B31B 3/00* (2006.01)

(52) U.S. Cl. ..... 493/58; 493/143; 29/465

(58) Field of Classification Search ..... 493/58, 493/143; 269/71; 29/71, 465
See application file for complete search history.

(56) References Cited

U.S. PATENT DOCUMENTS

| | | | | |
|---|---|---|---|---|
| 5,163,894 | A * | 11/1992 | Ogawa | 493/468 |
| 5,810,233 | A * | 9/1998 | Varidel | 225/97 |
| 6,203,482 | B1 * | 3/2001 | Sandford | 493/61 |
| 6,520,900 | B1 * | 2/2003 | Sandford | 493/373 |
| 2009/0205190 | A1 * | 8/2009 | Asai | 29/465 |

* cited by examiner

*Primary Examiner* — Hemant M Desai
(74) *Attorney, Agent, or Firm* — Manabu Kanesaka

(57) ABSTRACT

A positioning-jig 42 is cylindrical shape and chamfered at the top side; wherein a bottom side inner diameter of the positioning-jig 42 is larger than outer diameter of the marking-member 12, and the bottom side outer diameter of the positioning-jig 42 is same or slightly smaller than the through-holes 20 belongs to the face plate 15.

3 Claims, 13 Drawing Sheets

POSITIONING-JIG FOR ADJUSTING A FACE PLATE

BACKGROUND OF THE INVENTION

1. Field of the Invention

The present invention relates to a positioning jig for adjusting a face plate. The positioning-jig is such as an adjusting guide for a face plate on a female-die in a stamping machine. Both a male-die and a female-die opposition in a stamping machine and the stamping machine stamping out a sheet and making a fold-line on the sheet at once, in which mounting a face plate on a female-die.

2. Description of the Prior Art

Generally, when a paperboard box (a box body) is made as shown in FIG. 5, stamp out a sheet 28 by Thomson blade (stamp-blade) 26 on a male-die (blank-die) 22 and make a valley fold-line 30 on the sheet 28 by rule-blade 25 on the blank-die 22 at once, and form a blank (stamped sheet) 29, and then bend the blank 29 along the fold-line 30 on it to making for a box body. A box body is made as such kind of paper, cardboard, plastic sheet, and these composition materials. A box body is popular in food industry, electric components industry, and automotive industry, because lightweight and good portability it has. Regarding the food industry, we can see many kinds of unique packages as limited regional specialties, for example. Thus, the market required a set of male-die and female-die and the mounting structure thereof, which is corresponding to small quantity and varied types of box bodies.

Prior art as a blank-die 22 used for stamping a sheet 28 is laser cutting on a block-board and making a slit for Thomson blade as a belt shape according to outline for unfolded box body and also making a slit for rule-blade as a belt shape according to fold-line for unfolded box body, and then fitting the Thomson blade 26 in the slit and also fitting the rule-blade 25 which height is lower than the Thomson blade 26 in the slit, and then making the blank-die 22 in general. The blank-die 22 is set on a chase (frame). A metal plate is fixed at undersurface (bottom) of the chase. The metal plate is as for backing and leveling. Both a male-die set on a chase and a female-die opposition in a stamping machine and the stamping machine stamping out a sheet and making a fold-line on the sheet at once, in which mounting a face plate on a female-die. Stamped forms of the sheet are necessary to correspond as varied types of box bodies. In case of small quantity and varied types of box bodies, frequently set the customized blank-die 22 on the stamping machine and take a stamping work, and set the customized blank-die 22 off the stamping machine.

As a stamping process insert a sheet 28 between the blank-die 22 set on the upper side of the stamping machine and the cutting-plate (female-die) 21 set on the lower side of the stamping machine, and the cutting-plate 21 up and then down, and then stamping out the sheet 28 so that blank (stamped sheet) 29 is cut on the given shape by the Thomson blade 26 and also a lot of fold-line 30 are on it by the rule-blade 25 at once. In the next, bend the blank 29 along the fold-line 30 on it and make a box body. For above structure, it is necessary addition a counter part (says face-cutting) on the cutting-plate 21, for which support to rule a fold-line 30 accurately and prevent to break up on the surface of the fold-line 30 (See FIG. 5).

In recent years, a face plate 15 which has pressure-sensitive adhesive on it back and can be post and peel repeatedly are invented, and the face plate 15 such a leaf so called "face film sheet" or "CAD-plate", and face plate 15 is adhered to a cutting-plate 21 by it pressure-sensitive adhesive. Because, face plate 15 is not only use in general but also use in economical. The CAD-plate 15 is made of a procedure as next. Uses the CAD data to making a blank-die 22 and draw the unfolded box body on a film sheet 18, and fix a tape on the rule-blade 25 position corresponding line and make a counter part that seems smooth ridge line and trapezoid viewed from the side, and then cut off the part which Thomson blade 26 touches. Also for above a CAD-plate 15 is making next procedure. Uses the CAD data to making a blank-die 22 and draw the unfolded box body on such a Bakelite board (Bakelite is a trademark), and put a groove the rule-blade 25 position corresponding line and make a counter part, and then cut off the part which Thomson blade 26 touches (refer to FIG. 5).

Prior art as a method of mounting a face plate on a cutting-plate (female-die) for stamping machine is making next procedure. Make a guide-pin on the blank-die (male-die) and make a guide-hole opposition on the female-die, and set marking-members on the female-die guided the guide-pin and the guide-hole. After that, set a CAD-plate with set-holes on the female-die inserted the marking-members 12. And the CAD-plate adhered on the female-die, for example. On the other way, a female-part which has a concave part and is attached into the positioning-holes at the male-die detachably, a male-part which comprises an axial part inserted detachably into the concave part of the female-part and a dish-shaped head part connected to the axial part, and further provides a positioning method comprising the following steps; set the female-part on each positioning-holes and set the marking-members on each male-part; and test run the stamping machine to attaches the male-die and the female-die, and adhered the marking-members on the female-die; and adhered the CAD-plate on the female-die for the marking-members inside each through-holes (refer to JP3429828B2).

Prior art as a method of mounting a face plate on a female-die that is constructed a stamping machine; and the stamping machine has a male-die that is opposite side of the female-die; and the male-die has a stamp-blade according to outline of a unfolded box body and a rule-blade according to a valley fold-line of the unfolded box body; and the face plate such as a plate or a film sheet that has a groove to accept a projection according a hill fold-line as to be opposed the valley fold-line; and the face plate is stick on the female-die; and the stamping machine stamping out a sheet inserted and making the fold-line on the sheet at once; wherein the male-die has two or more positioning-holes at a given interval for positioning the face plate, wherein the face plate has two or more through-holes that a one-to-one correspond to the positioning-holes, and two or more marking-members that has an adhesive layer at the back and stick the adhesive layer on the female-die at the through-hole positions used by the positioning-jig that has the marking-member detachably, and further provides a positioning method comprising the following steps; set the positioning-jigs on each positioning-holes and set the marking-members on each positioning-jigs exposed the adhesive layer; and test run the stamping machine to attaches the male-die and the female-die, and adhered the marking-members on the female-die; and adhered the face plate on the female-die for the marking-members inside each through-holes (refer to JP3141440Y).

However, in the above method by using the prior art, sometimes occur positioning shift of the marking-members on the female-die, while adhering the face plate on the female-die for the marking-members inside each through-holes. A face plate has two or more through-holes at a given interval that through-holes are one-to-one correspond to the marking-members on the female-die. If the face plate slants to the female-die, bottom of the face plate specially edge of the through-hole attaches to the marking-members on the female-die. Then, sometimes position of the marking-members on the female-die shifted. Prior art as shown in FIG. 6, multiple face plates mount on the female-die at once. In case of the multiple face plates mount on the female-die at once, the marking-members on the female-die are easy to shift their positions. Therefore, position of the face plate mounted on the female-die is not certainty.

Generally, in the above method by using the prior art, an adhesive resin is applied on bottom of a face plate, and the face plate is stuck on the female-die by the adhesive resin. If the face plate slants to the female-die, a bottom part of the face plate specially edge of the face plate stick on the female-die at fast. Then, sometimes position of the face plate on the female-die shifted. In case of the larger size of face plates mount on the female-die are easy to shift their positions. Therefore, position of the face plate mounted on the female-die is not certainty.

The present invention has been proposed in view of the conventional actual situation, and the object thereof is to provide a positioning-jig for adjusting a face plate that is prevention of positioning shift occurrence while mounting the face plate on the female-die, and position of the face plate mounted on the female-die is certainty.

BRIEF SUMMARY OF THE INVENTION

The present invention provides a positioning-jig for adjusting a face plate on a female-die that is constructed a stamping machine; and a male-die is opposite to the female-die; and the male-die comprising metal-blade as a stamp-blade according to outline of a unfolded box body and a rule-blade according to a valley fold-line of the unfolded box body; and a groove of a face plate accept a projection according a hill fold-line as to be opposed the valley fold-line; and a marking-member; and the marking-members are stuck on the female-die by attached the male-die and the female-die; and the positioning-jig uses on the female-die while the face plate adhered on the female-die guided the marking-members inside each two or more through-holes belongs to the face plate; wherein the positioning jig is symmetry shape at the top side; wherein a bottom side inner diameter of the positioning-jig is larger than outer diameter of the marking-member, and the bottom side outer diameter of the positioning-jig is same or slightly smaller than the through-holes belongs to the face plate. According to the present invention, a mounting method used above the positioning-jigs that the mounting method proper for comprising steps of: set the positioning-jigs on the female-die and cover to marking-members one-to-one corresponded; and through the through-holes belongs to the face plate on each positioning-jigs and make the face plate parallel with the female-die and tentatively hold the face plate by bottom side outline of the positioning-jig; and press down the top side of the face plate keeping parallel stance; and contact the face plate plane-to-plane with the female-die and stick the face plate with the female-die.

According to the present invention, set the positioning-jigs on the female-die and cover to marking-members one-to-one corresponded; and through the through-holes belongs to the face plate on each positioning-jigs and make the face plate parallel with the female-die and tentatively hold the face plate by bottom side outline of the positioning-jigs; and press down the top side of the face plate keeping parallel stance; and contact the face plate plane-to-plane with the female-die and stick the face plate with the female-die. Therefore, the positioning-jigs prevent to positioning shift occurrence while mounting the face plate on the female-die, and position of the face plate mounted on the female-die is certainty. Shape of the marking-member is point symmetry. For example, shape of the marking-member is desk, circular cylinder, annular ring, cube, hexagonal column, or, octagonal column. Shape of the positioning-jig is point symmetry. For example, shape of the positioning-jig is desk, circular cylinder, annular ring, cube, hexagonal column, octagonal column, conical cone, truncated circular cone, or, convex polygon.

According to the present invention, the positioning-jig comprises a magnet-part on bottom side of it possibly. In case of the female-die comprising ferromagnetic metal or ferromagnetic metal plate on surface of the female-die, the positioning-jig can be stick on the female-die by magnetic force itself.

According to the present invention, the positioning-jig comprises a press-down-jig as an attachment to the positioning-jig; wherein the press-down-jig is hollow symmetry shape at the top side, and inside diameter of the press-down-jig is slightly larger than outer diameter of the positioning-jig. According to the present invention, the mounting method used above the positioning-jigs that the mounting method proper for comprising steps of: press down the top side of the face plate keeping parallel stance by the press-down-jig.

According to the present invention, make the face plate parallel with the female-die and tentatively hold the face plate by bottom side outline of the positioning-jigs; and press down the top side of the face plate keeping parallel stance by the press-down-jig. Thus, press down surround of the through-holes belongs to the face plate at fast, and contact the face plate plane-to-plane with the female-die certainly. The press-down-jigs put on each position of the positioning-jigs and press down at once for keeping parallel stance of the face plate. Shape of the press-down-jig is point symmetry. For example, shape of the press-down-jig is hollow cylindrical shape, annular ring, hollow cube, hollow hexagonal column, hollow octagonal column, hollow conical cone, hollow truncated circular cone, or, hollow convex polygon.

According to the present invention, wherein the positioning-jig comprises a hollow part on bottom side, and diameter of the hollow part is same or slightly larger than diameter of the marking-member, and depth size of the hollow part is same or slightly larger than thickness size of the marking-member.

According to the present invention, the positioning-jig covers the marking-member, completely. Therefore, the face plate doesn't touch the marking-member.

According to the present invention, a center-hole is formed the marking-member, and wherein the positioning-jig comprises a projection part on bottom side which the projection part fit to the center-hole preferably. According to the present invention, when the positioning jigs set on the female-die, the projection part of positioning-jig fit to the center-hole of marking-member. Therefore, the positioning-jigs prevent to positioning shift occurrence at the marking-members, and the positioning-jigs set on marking-members.

According to the present invention, wherein a micro-depression as micro-suckers are formed on bottom side of the face plate preferably; and press down the top side of the face plate and attaches the female-die, and push the face plate by given pressure which is air deflated the micro-depressions and the micro-suckers functions by negative pressure, and stick the face plate with the female-die. According to the present invention, the micro-suckers are formed on bottom side of the face plate. Thus, if not push the face plate on the female-die, the face plate doesn't stick on the female-die.

Therefore, it can be check the face plate position that the face plate attached the female-die, and push the face plate by given pressure and stick the face plate plane-to-plane with the female-die accurately.

According to the present invention, set the positioning-jigs on the female-die and cover to marking-members one-to-one corresponded; and through the through-holes belongs to the face plate on each positioning-jigs and make the face plate parallel with the female-die and tentatively hold the face plate by bottom side outline of the positioning-jigs; and press down the top side of the face plate keeping parallel stance; and contact the face plate plane-to-plane with the female-die and stick the face plate with the female-die. Therefore, the positioning-jigs prevent to positioning shift occurrence while mounting the face plate on the female-die, and position of the face plate mounted on the female-die is certainty. According to the present invention, in case of the micro-suckers are formed on bottom side of the face plate, the face plate doesn't stick on the female-die. Because, when doesn't push the face plate on the female-die, the face plate doesn't stick on the female-die.

Therefore, it can be check the face plate position that the face plate attached the female-die, and push the face plate by given pressure and stick the face plate plane-to-plane with the female-die accurately.

DETAILED DESCRIPTION OF THE INVENTION

The above and other objects, characteristic features and advantages of the present invention will become apparent to those skilled in the art from the description to be given herein below with reference to the accompanying drawings.

Figure 1A:
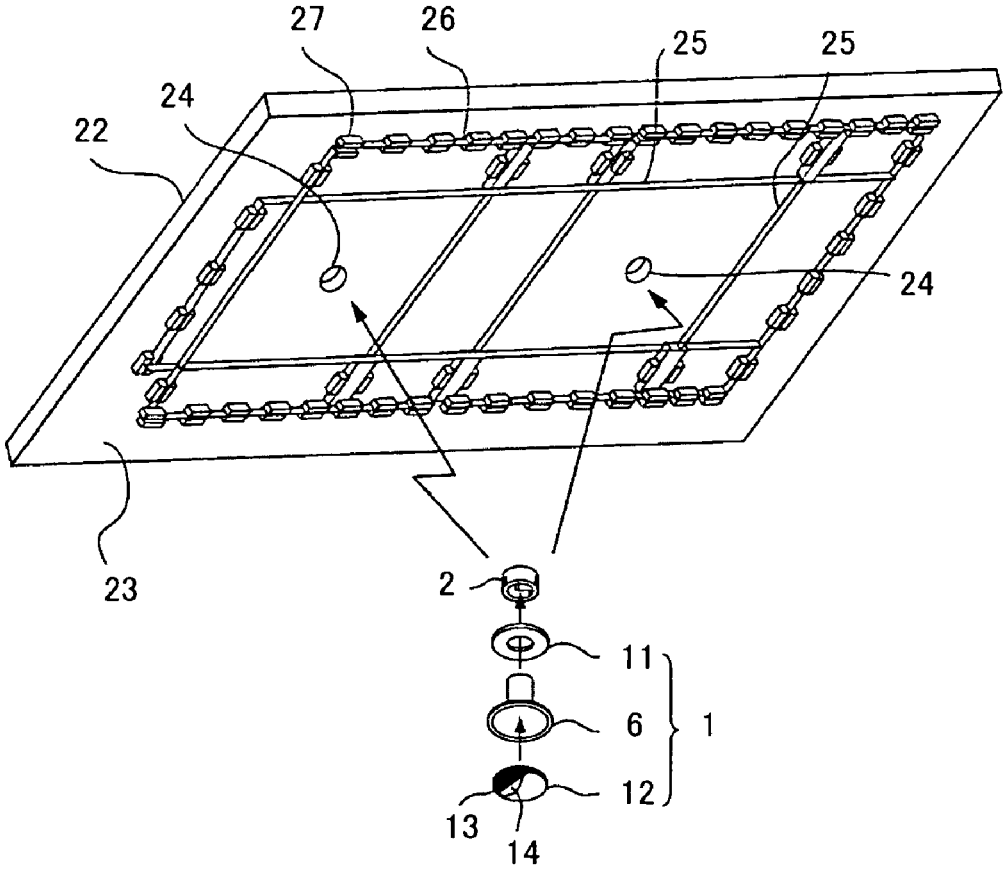
FIG. 1A Prior Art
FIG. 1A is a perspective view showing an example relation between a marking-member holding-jig and a male-die as a prior art.
Figure 1B:
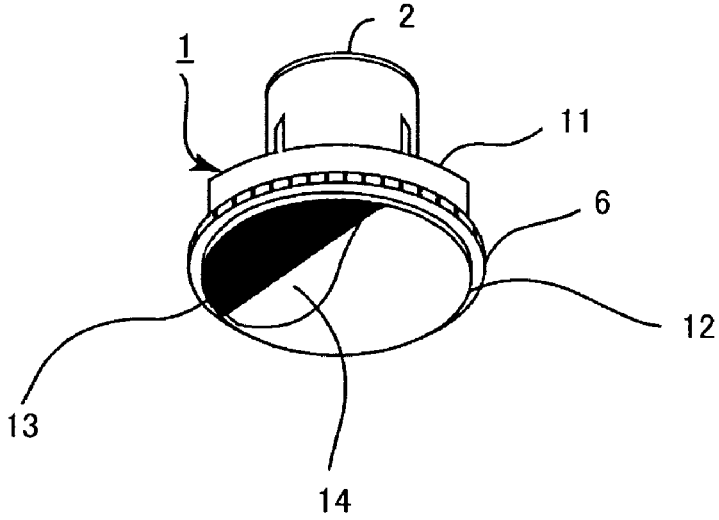
FIG. 1B Prior Art
FIG. 1B is a perspective view showing of the marking-member holding-jig as a prior art.
Figure 2:
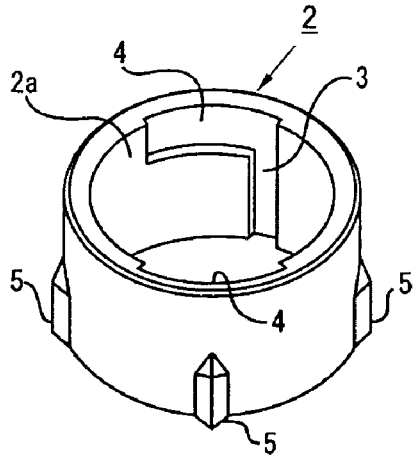
FIG. 2 Prior Art
FIG. 2 is a perspective view showing of the female-part of the marking-member holding-jig as a prior art.
Figure 3:
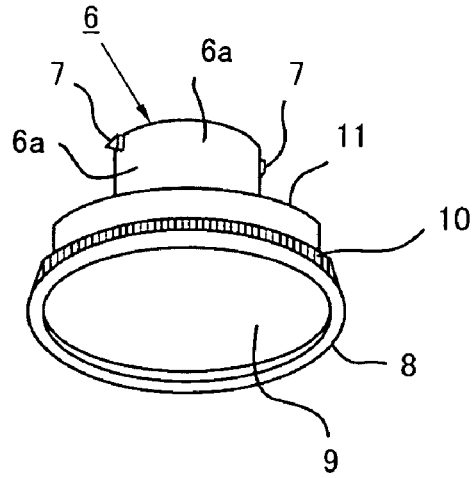
FIG. 3 Prior Art
FIG. 3 is a perspective view showing of the male-part of the marking-member holding-jig as a prior art.
Figure 4:
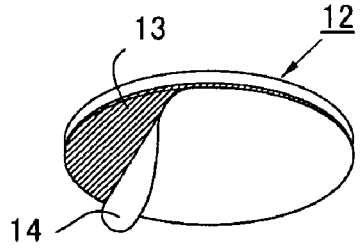
FIG. 4 Prior Art
FIG. 4 is a perspective view showing of the marking-member as a prior art.

A prior art marking-member holding-jig 1 comprises a female-part 2, male-part 6, and a flat washer-shaped elastic body 11. A marking-member holding-jig 1 set to male-die 22 (See FIG. 1A). A female-part 2 has formed the longitudinal-thin-wall-part 3 at arbitrary high from a cylindrical inner bottom and on symmetrical positions inner of the cylinder of the predetermined size, a lateral thin wall part 4 extending from an intermediate part between the longitudinal-thin-wall-part 3 and having arbitrary wide, and a number of small and wedge-shaped (or arrowhead-shaped) protuberances 5 in a cylindrical outer bottom (See FIG. 2). A male-part 6 is an arbitrary height and a predetermined size which enable a male-part 6 to set in a female-part 2, and the male-part 6 includes a cylindrical axial part 6*a*; wherein the cylindrical axial part 6*a* is same or slightly smaller than a cylindrical inside dimension of the female-part 2 and having an arbitrary embedded space (dent part), is provided with a locking part 7 on symmetrical positions at the top of this cylindrical axial part 6*a* and a dish-shaped head part 8 the bottom of the cylindrical axial part 6*a*. The dish-shaped head part 8 is provided with a circular concavity part 9 of an arbitrary deep and an arbitrary size at the bottom and is put in a flat washer-shaped elastic body 11 of an arbitrary thickness at the top (See FIG. 3). A marking-member 12 is a circular-flat plate-shaped matter of a size such as possible to be put in the circular concavity part 9 at the bottom of the dish-shaped head part 8, and a thickness such as it projects from the concavity part 9 at the bottom of the dish-shaped head part 8, and it has a adhesive layer 13 at the bottom. A released paper 14 is covered on an adhesive layer 13. The marking-member 12 is made of a sponge or a rubber.

Figure 5:
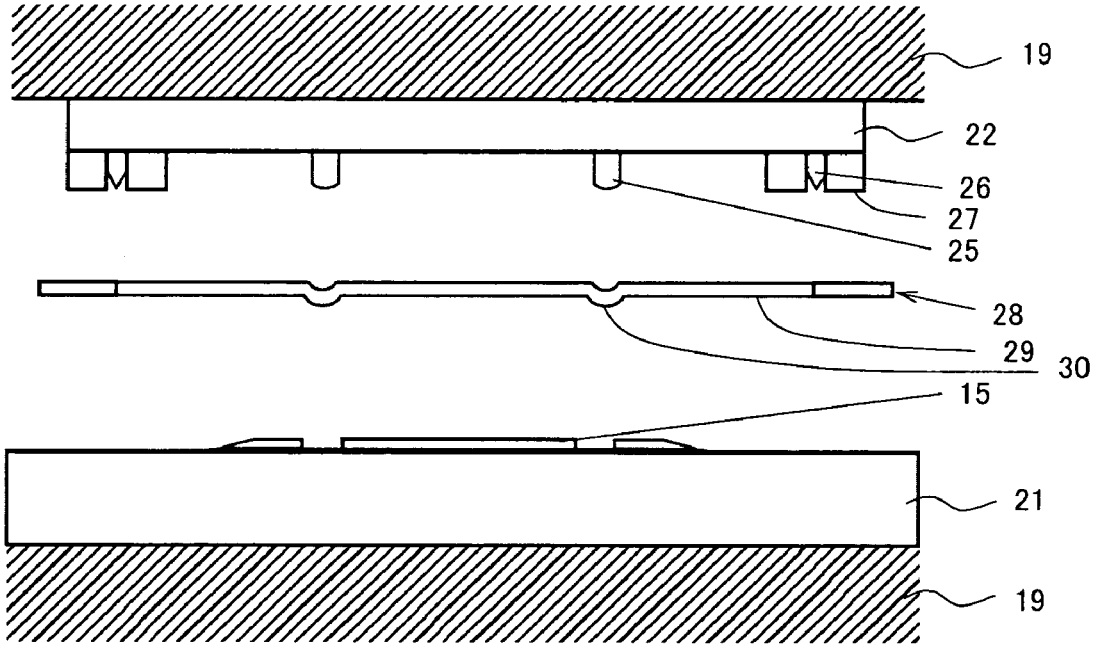
FIG. 5 Prior Art
FIG. 5 is a side view showing of the stamping procedure of a sheet inserted between the male-die set on the upper side of the stamping machine and the female-die set on the lower side of the stamping machine as a prior art.

An embodiment of a positioning-jig 42 according to the present invention used to mount a face plate 15 on a female-die 21 that is constructed a stamping machine 19; and a male-die 22 that is opposite to the female-die 21; and the male-die 22 comprising metal-blade as a stamp-blade 26 according to outline of a unfolded box body and a rule-blade 25 according to a valley fold-line of the unfolded box body; and a groove of a face plate 15 accept a projection according a hill fold-line as to be opposed the valley fold-line (See FIG. 5).

Figure 7A:
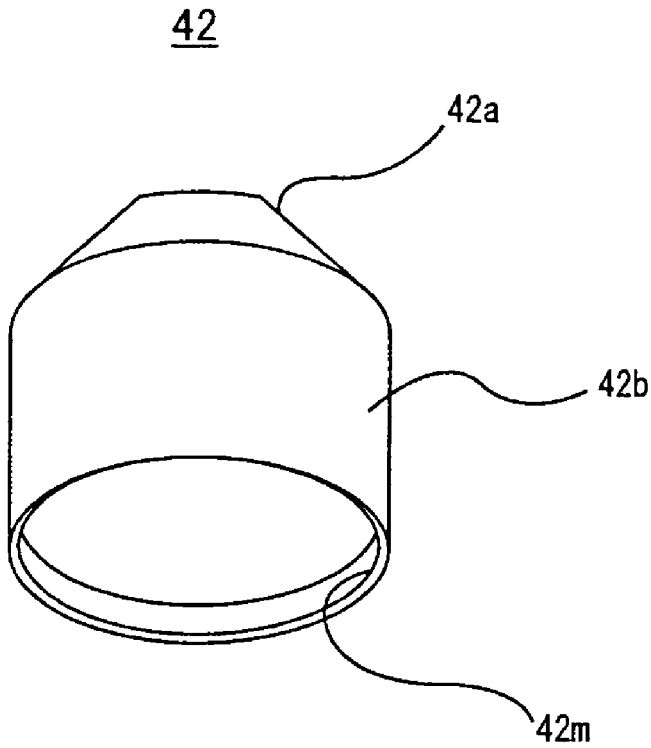
FIG. 7A is a perspective view showing an example of the positioning-jig according to the Embodiment 1.
Figure 7B:
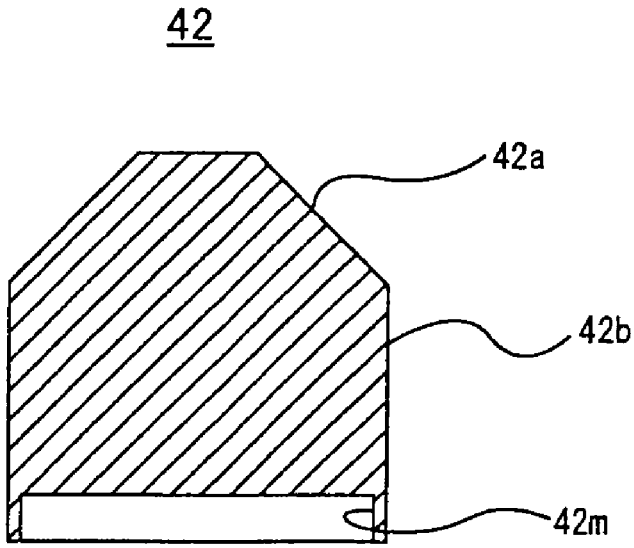
FIG. 7B is a side section view showing the positioning-jig as above the Embodiment 1.
Figure 8A:
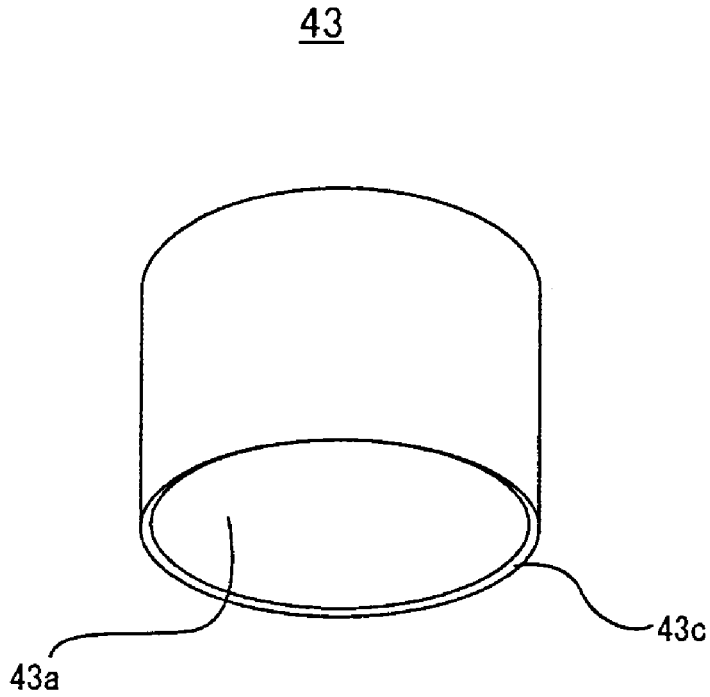
FIG. 8A is a perspective view showing an example of the press-down-jig according to the positioning-jig as above the Embodiment 1.
Figure 8B:
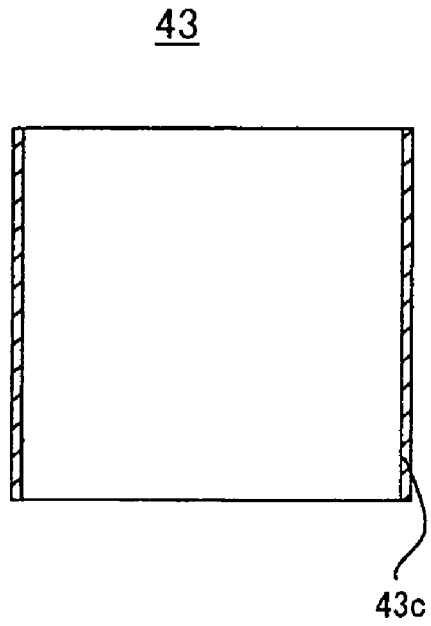
FIG. 8B is a side section view showing the press-down-jig according to positioning-jig as above the Embodiment 1.

According to the embodiment 1, a positioning-jig 42 comprises a cylindrical part 42*b* and sloped part 42*a* that sloped part 42*a* is chamfered at top of the cylindrical part 42*b*. The sloped part 42*a* is a shape which is easy to through a through-hole 20 belongs to the face plate 15. A bottom side inner diameter of the positioning-jig 42 is slightly larger than outer diameter of the marking-member 12, and the bottom side outer diameter of the positioning-jig 42 is same or slightly smaller than diameter of the through-hole 20 belongs to the face plate 15. From the upper to the bottom, the outer diameter of the positioning-jig 42 is closing to the diameter of through-hole 20. For example, shape of the cylindrical part 42*b* is same diameter of a straight upward and downward as the embodiment 1 (See FIG. 7A). The other example, from the upper to the bottom, the outer diameter of the positioning-jig 42 is gradually closing to the diameter of through-hole 20 (See FIG. 17A)

As the embodiment 1, the positioning-jig 42 comprises a hollow part on bottom side, and diameter of the hollow part is same or slightly larger than diameter of the marking-member 12, and depth size of the hollow part is same or slightly larger than thickness size of the marking-member 12. Thus, inner wall 42*m* of the positioning-jig 42 covers the marking-member 12, completely. Therefore, the face plate 15 doesn't touch the marking-member 12.

The positioning-jig 42 is made of metal such like an iron or aluminum. Then, the positioning-jig 42 functions such as paperweight. Therefore, the positioning-jig 42 doesn't move when the face plate 15 attaches.

A ferromagnetic metal plate 21*a* is on surface of the female-die 21. When a positioning-jig 42 comprises a magnet-part on bottom side, the positioning-jig 42 can be stick on the female-die 21 by magnetic force itself, for example. In case of the positioning-jig 42 is made of a ferromagnetic metal such like an iron or stainless steel. When marking-member 12 comprises a magnet-part such like rubber magnet on top side, the marking-member 12 can be stick on the positioning-jig 42 by magnetic force itself, for example.

According to the embodiment 1, the positioning-jig 42 comprises a press-down-jig 43 as an attachment to the positioning-jig 42, and a press-down-jig 43 is used for pressing down the top side of the face plate 15 keeping parallel stance. The press-down-jig 43 is hollow cylindrical shape and inside diameter of the press-down-jig 43 is slightly larger than outer diameter of the positioning-jig 42. The press-down-jig 43 is made of metal such like an iron or aluminum. As the embodiment 1, the hollow of the press-down-jig 43 is open space 43*a*. In case of the hollow of the press-down-jig 43 is closed space 43*a* that is acceptable to use.

According to the embodiment 1, the face plate 15 mounting procedure used the positioning-jig 42 is explain as below.

Figure 6:
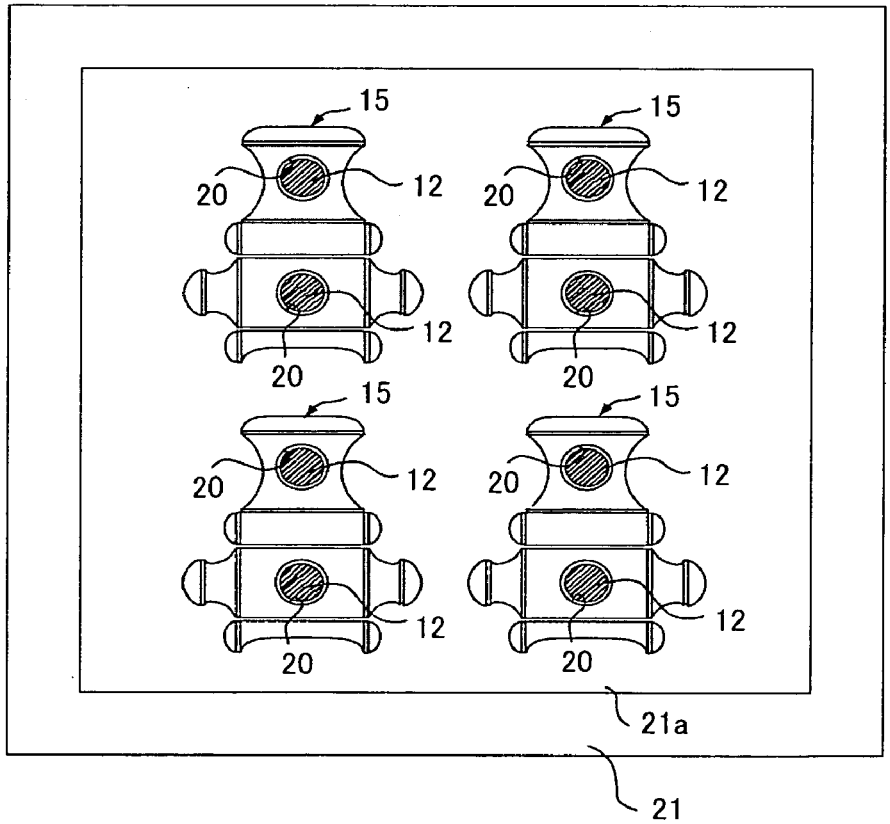
FIG. 6 Prior Art
FIG. 6 is a top view showing of four pieces of the face-plates mounted on the female-die as a prior art.
Figure 9A:
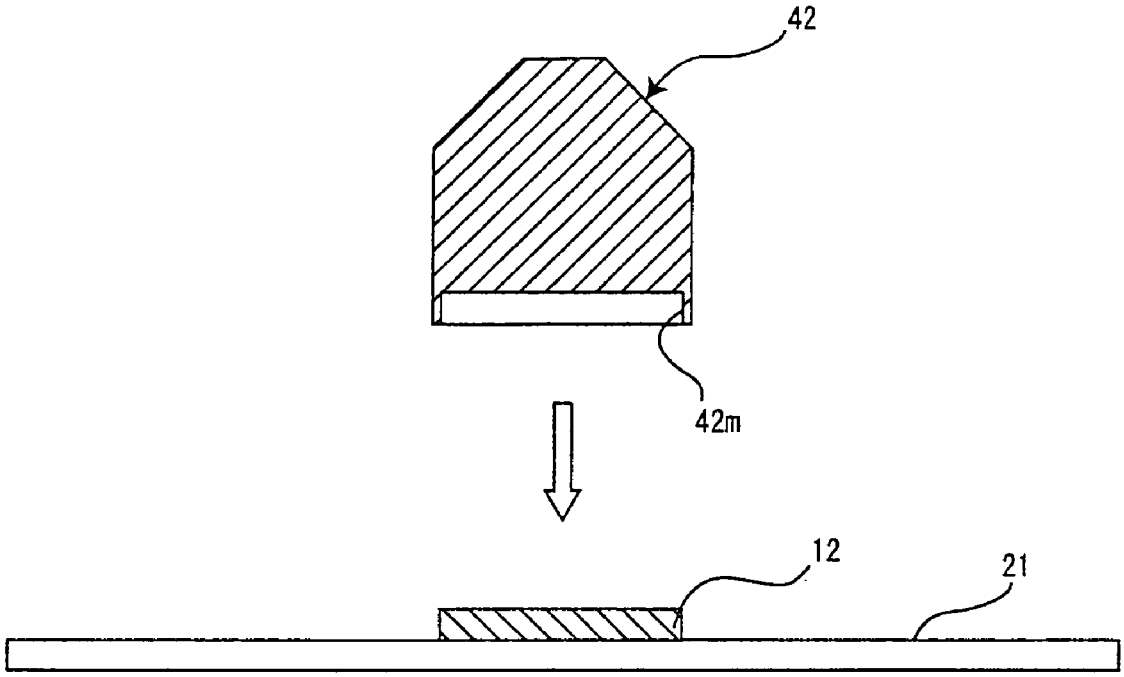
FIG. 9A is a side section view showing of a step of the face plate mounting procedure used the positioning-jig as above the Embodiment 1.
Figure 9B:
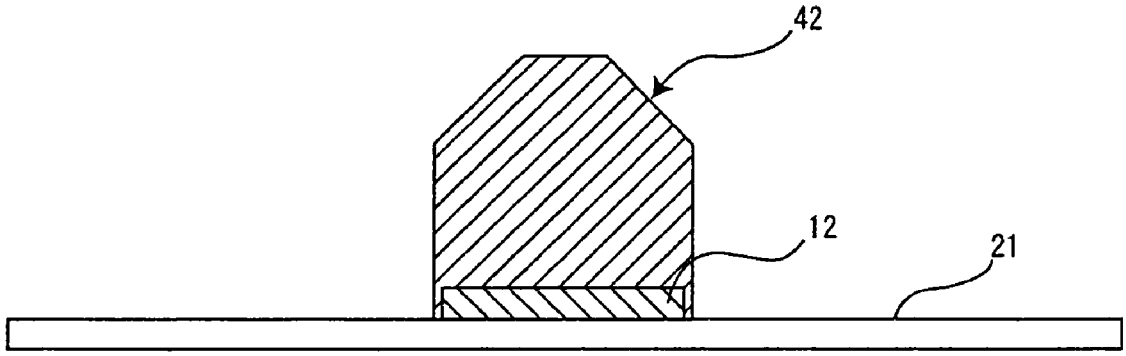
FIG. 9B is a side section view showing of a step of the face plate mounting procedure used the positioning-jig as above the Embodiment 1.

First, stick a desk shaped marking-member 12 on the female-die 21 uses as known method. Next, pick the positioning-jig 42 up to the top of the marking-member 12 (See FIG. 9A), and set the positioning-jig 42 on the marking-member 12 (See FIG. 9B). Thus, inner wall 42*m* of the positioning-jig 42 covers the marking-member 12, completely. As shown in FIG. 6, a face plate 15 has two through-holes 20 at a given interval, and four pieces of face plate 15 are mounted on the female-die 21. Thus, set multiple marking-members 12 on the female-die 21 that marking-members 12 are one-to-one correspond to the through-holes 20, and set multiple positioning-jigs 42 on the marking-members 12 that positioning-jigs 42 are one-to-one correspond to the marking-members 12.

Figure 10A:
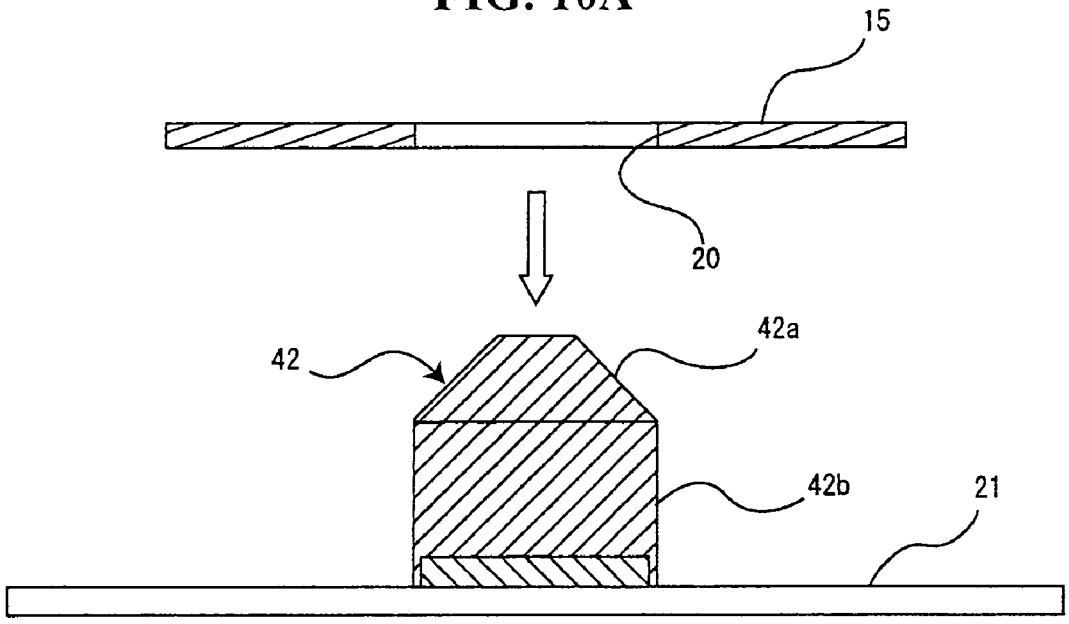
FIG. 10A is a side section view showing of a step of the face plate mounting procedure used the positioning-jig as above the Embodiment 1.
Figure 10B:
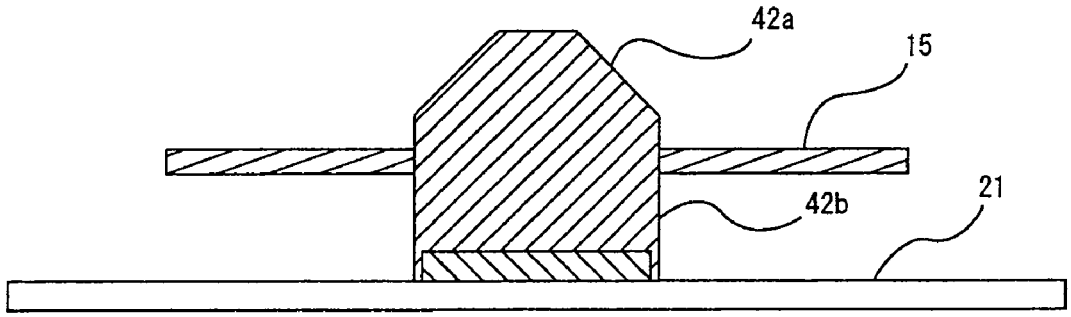
FIG. 10B is a side section view showing of a step of the face plate mounting procedure used the positioning-jig as above the Embodiment 1.

Next, fit the through-holes 20 of face plate 15 to the positioning-jigs 42 one-to-one corresponded. That is, pick the face plate 15 up to the top of positioning jigs 42 for adjusting the through-holes 20 up to the top of positioning-jigs 42 (See FIG. 10A), and through the through-holes 20 belongs to the face plate 15 on each sloped part 42*a* of positioning-jigs 42. Then, the face plate 15 is parallel with the female-die 21 and the face plate 15 is tentatively held by bottom side outline of the cylindrical part 42*b* belongs to positioning-jig 42. There is a gap between the face plate 15 and the female-die 21 (See FIG. 10B). Reasons of why, the bottom side outer diameter of the cylindrical part 42*b* is same or slightly smaller than diameter of the through-hole 20, and multiple through-holes 20 are fit to the positioning-jigs 42 one-to-one corresponded.

Figure 11A:
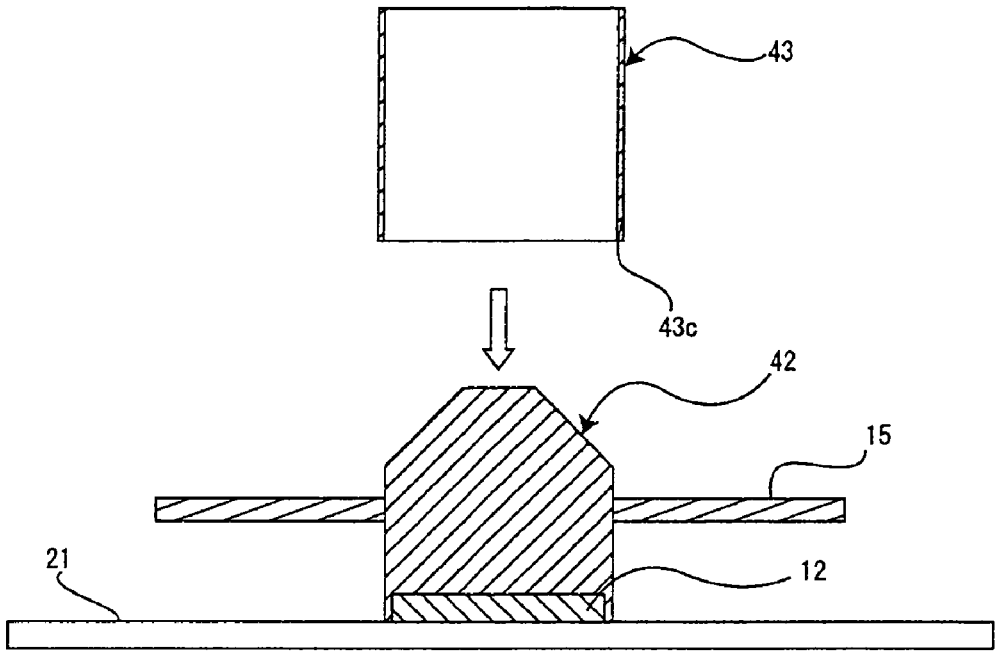
FIG. 11A is a side section view showing of a step of the face plate mounting procedure used the positioning-jig as above the Embodiment 1.
Figure 11B:
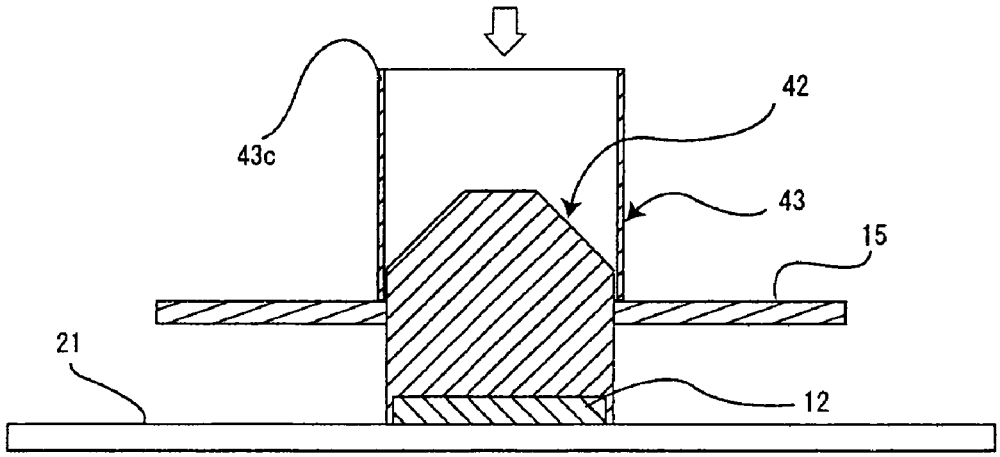
FIG. 11B is a side section view showing of a step of the face plate mounting procedure used the positioning-jig as above the Embodiment 1.
Figure 11C:
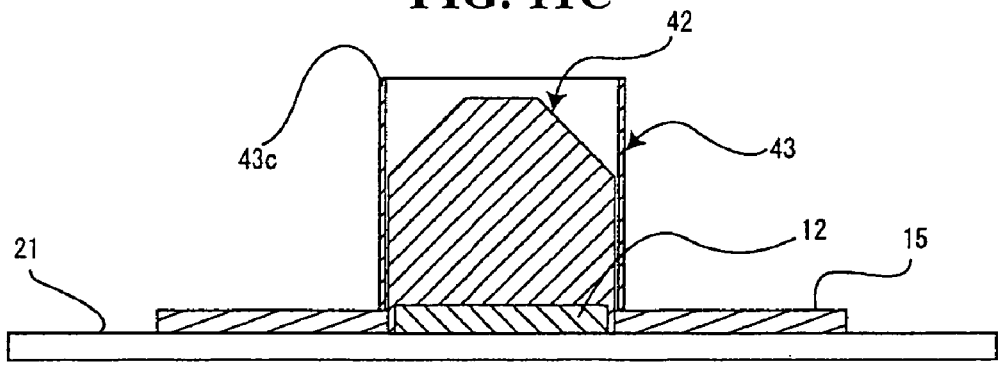
FIG. 11C is a side section view showing of a step of the face plate mounting procedure used the positioning-jig as above the Embodiment 1.

Next, pick the press-down-jig 43 up to the top of positioning-jigs 42 for adjusting the hollow of press-down-jig 43 up to the top of positioning-jig 42 (See FIG. 11A), and through the hollow of press-down-jig 43 on each sloped part 42*a* of positioning-jigs 42, and set the press-down-jig 43 on the face plate 15 (See FIG. 11B). Then, the cylindrical part 42*b* of positioning-jig 42 is covered by the press-down-jig 43. Multiple press-down-jigs 43 are fit to the multiple positioning-jigs 42 one-to-one corresponded. And press down the top side of the face plate 15 by the press-down-jigs 42. An adhesive resin is applied on bottom of a face plate 15, and then the face plate 15 is stuck on the female-die 21 by the adhesive resin (See FIG. 11C). According to the embodiment 1, the face plate 15 sticks on the female-die 21 plane-to-plane. As the embodiment 1, press downs the top side of the face plate 15 keeping parallel stance by the press-down-jigs 43. Thus, press down surround of the through-holes 20 belongs to the face plate 15 at fast, and contact the face plate 15 plane-to-plane with the female-die 21 certainly. The press-down-jigs 43 put on each position of the positioning jigs 42 and press down at once for keeping parallel stance of the face plate 15. In case of not used the positioning-jigs 42 and press down by hand that is acceptable.

Figure 12A:
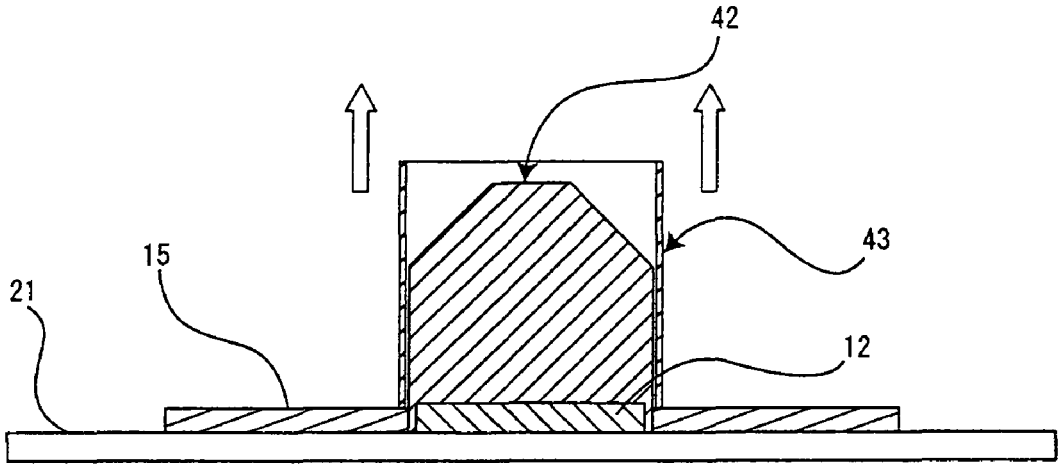
FIG. 12A is a side section view showing of a step of the face plate mounting procedure used the positioning-jig as above the Embodiment 1.
Figure 12B:
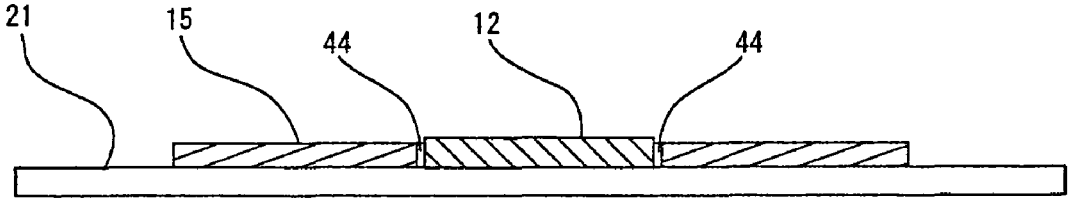
FIG. 12B is a side section view showing of a step of the face plate mounting procedure used the positioning-jig as above the Embodiment 1.

Next, pick the press-down-jig 43 up and remove, and then pick the positioning-jigs 42 up and remove (See FIG. 12A). According to the embodiment 1, the face plate 15 has two through-holes 20 at a given interval, and the multiple through-holes 20 are set around the marking-members 12 that through-holes 20 are one-to-one correspond to the marking-members 12. Around the marking-members 12 is formed a gap 44 between the marking-member 12 and the face plate 15 (See FIG. 12B).

Figure 17A:
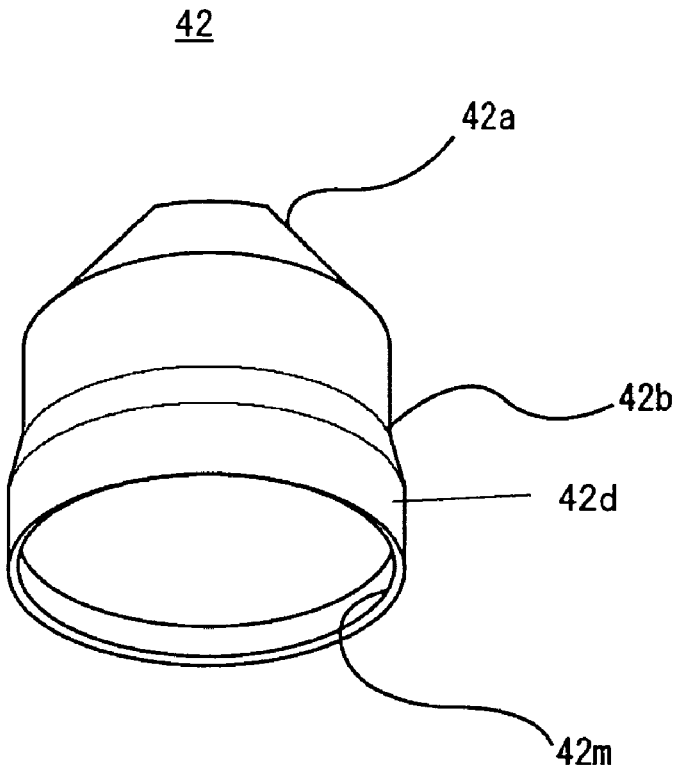
FIG. 17A is a perspective view showing another example of the positioning jig according to the Embodiment 1.
Figure 17B:
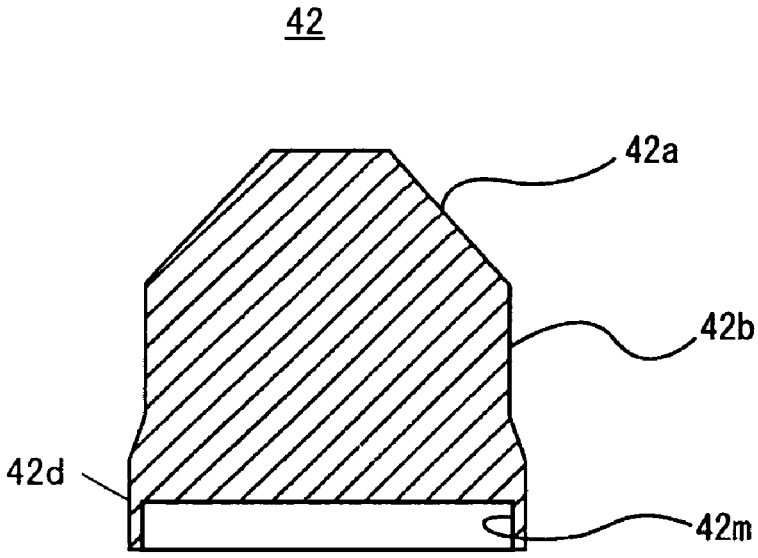
FIG. 17B is a side section view showing another example of the positioning-jig according to the Embodiment 1.

According to the embodiment 1, application example is shown in FIG. 17A and FIG. 17B. A positioning-jig 42 comprises an additional bulging part 423*d* under the cylindrical part 42*b*, and a bottom side outer diameter of the bulging part

423*d* is slightly larger than upper side, and outer diameter of the bulging part 423*d* closing to the diameter of through-hole 20. Therefore, the face plate 15 is parallel with the female-die 21 and the face plate 15 is tentatively held by bottom side outline of the bulging part 42*d* belongs to positioning-jig 42. There is a gap between the face plate 15 and the female-die 21.

Figure 13A:
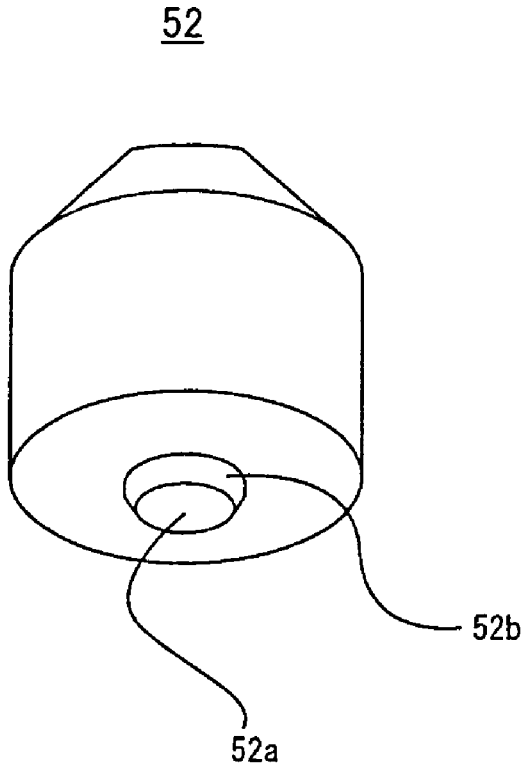
FIG. 13A is a perspective view showing an example of the positioning-jig according to the Embodiment 2.
Figure 13B:
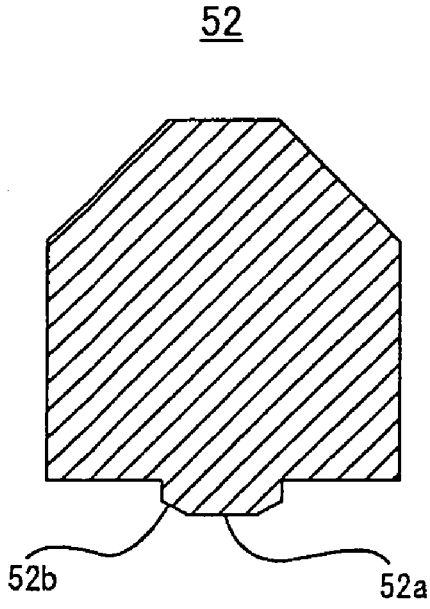
FIG. 13B is a side section view showing the positioning-jig as above the Embodiment 2.
Figure 14A:
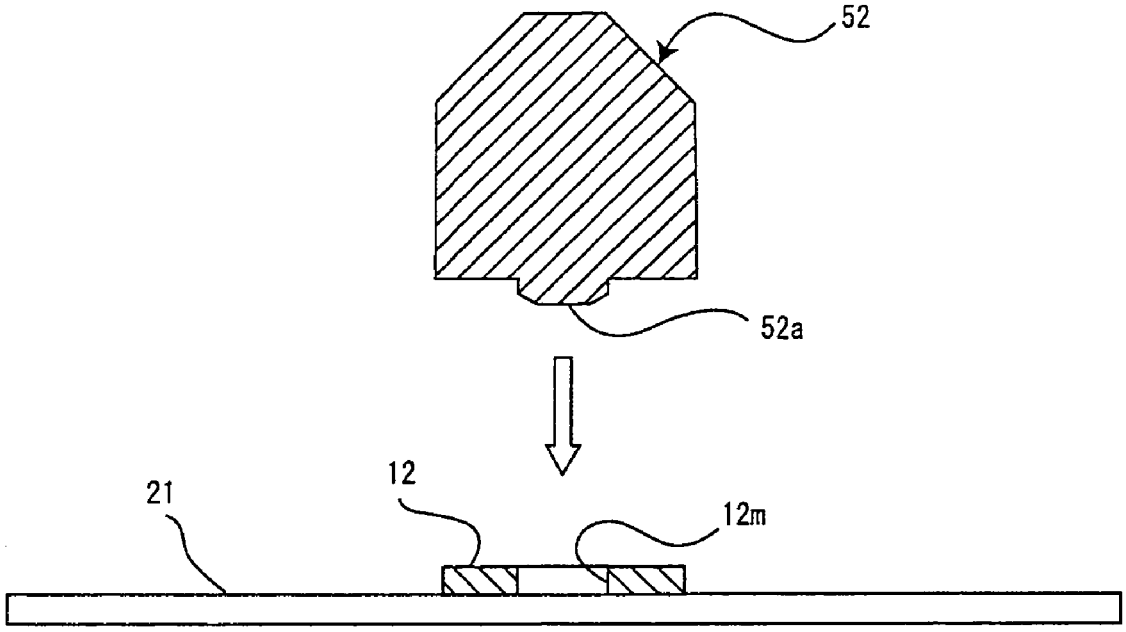
FIG. 14A is a side section view showing of a step of the face plate mounting procedure used the positioning jig as above the Embodiment 2.
Figure 14B:
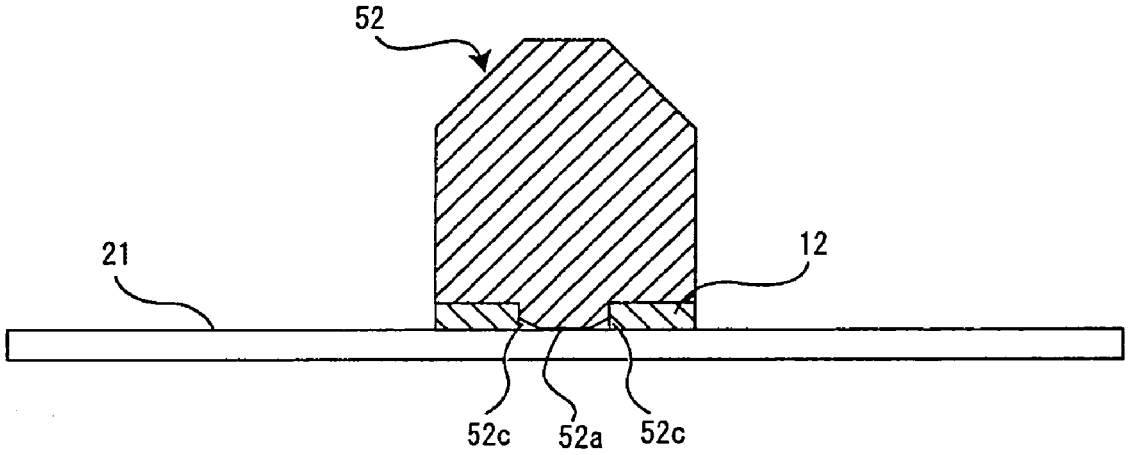
FIG. 14B is a side section view showing of a step of the face plate mounting procedure used the positioning-jig as above the Embodiment 2.

A center-hole 12*m* is formed the marking-member 12 (refer to FIG. 14A). According to the embodiment 2, the positioning-jig 52 comprises a projection part 52*a* on bottom side which the projection part fit to center-hole 12*m* of the marking-member 12 (See FIG. 13A). Outer diameter of the positioning-jig 52 is same as the diameter of center-hole 12*m*, and projected length of the projection part 52*a* is same as the thickness of marking-member 12. A sloped part 52*b* is chamfered at bottom of the projection part 52*a*. The sloped part 52*b* is a shape which is easy to through a center-hole 12*m* belongs to the marking-member 12. Outer diameter of the projection part 52*a* is same or slightly smaller than the diameter of center-hole 12*m*. Therefore, the positioning-jigs 52 prevent to positioning shift occurrence at the marking-members 12, and the positioning-jigs 52 set on marking-members 12 (See FIG. 14B). The positioning-jig 52 is made of metal such like an iron or aluminum. Then the positioning-jig 52 functions such as paperweight. Therefore, the positioning-jig 52 doesn't move when the face plate 15 attaches. The positioning-jig 52 is acceptable to use for a center-hollow is formed on the marking-member 12. A ferromagnetic metal plate 21*a* is on surface of the female-die 21. When a positioning-jig 52 comprises a magnet-part on bottom side, the positioning-jig 52 can be stick on the female-die 21 by magnetic force itself, for example.

According to the embodiment 2, the positioning-jig 52 comprises a press-down-jig 53 as an attachment to the positioning-jig 52, a press-down-jig 53 is used for pressing down the top side of the face plate 15 keeping parallel stance. The press-down-jig 53 is hollow cylindrical shape and inside diameter of the press-down-jig 53 is slightly larger than outer diameter of the positioning-jig 52. The press-down-jig 53 is made of metal such like an iron or aluminum.

According to the embodiment 2, the face plate 15 mounting procedure used the positioning-jig 52 is explain as below.

First, stick a ring shaped marking-member 12 on the female-die 21 uses as known method. Next, pick the positioning-jig 52 up to the top of the marking-member 12 (See FIG. 14A), and set the positioning-jig 52 on the marking-member 12 (See FIG. 14B). Thus, set multiple positioning-jigs 52 on the marking-members 12 that positioning-jigs 52 are one-to-one correspond to the marking-members 12. There is a gap 52*c* between the sloped part 52*b* and center-hole 12*m* of the marking-member 12.

Next, pick the face plate 15 up to the top of positioning-jigs 52 for adjusting the through-holes 20 up to the top of positioning-jigs 52, and through the through-holes 20 belongs to the face plate 15 on each sloped part 52*a* of positioning-jigs 42. Then, the face plate 15 is parallel with the female-die 21 and the face plate 15 is tentatively held by bottom side outline of the cylindrical part belongs to positioning-jig 52.

Figure 15A:
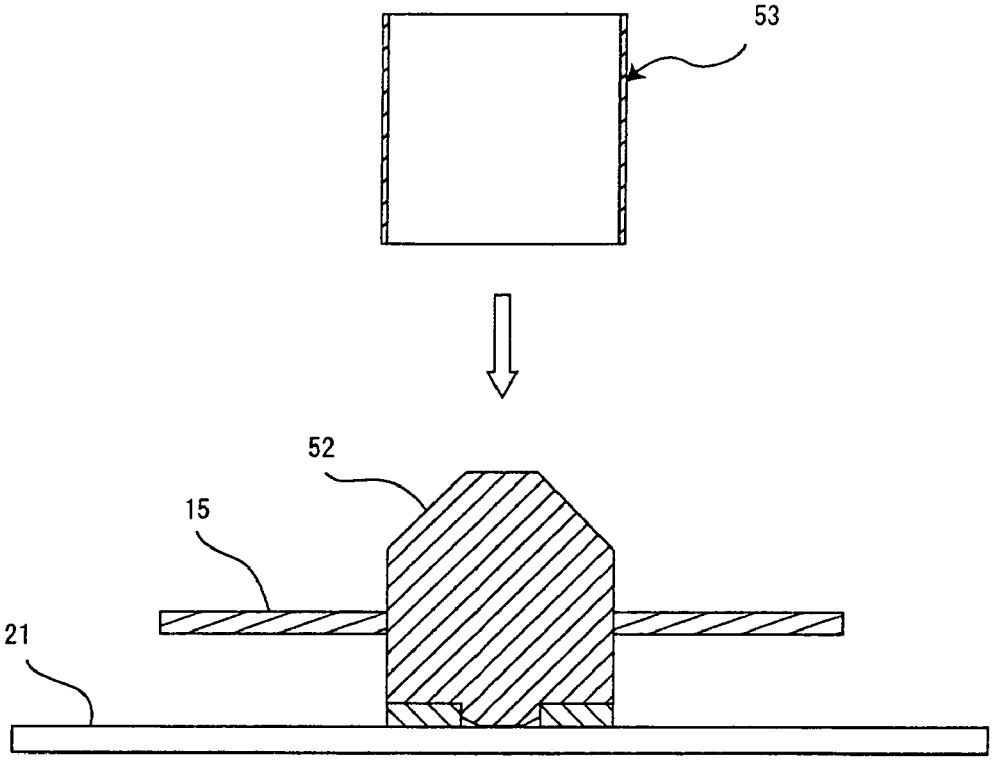
FIG. 15A is a side section view showing of a step of the face plate mounting procedure used the positioning-jig as above the Embodiment 2.
Figure 15B:
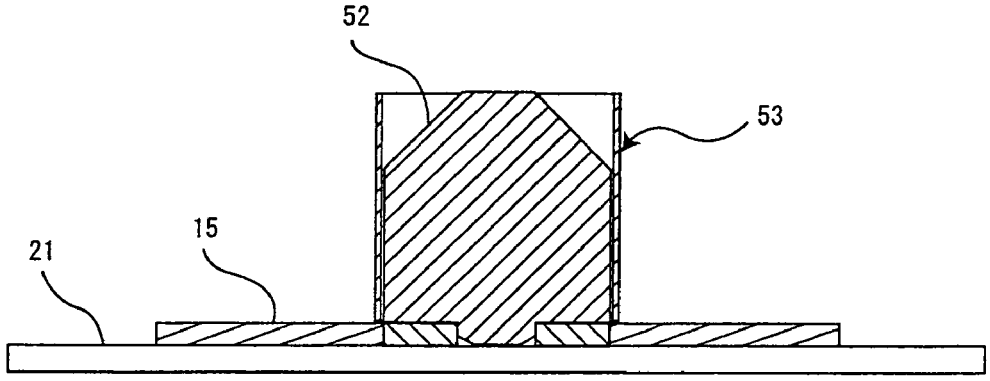
FIG. 15B is a side section view showing of a step of the face plate mounting procedure used the positioning-jig as above the Embodiment 2.

Next, pick the press-down-jig 53 up to the top of positioning-jigs 52 for adjusting the hollow of press-down-jig 53 up to the top of positioning-jig 52 (See FIG. 15A), and through the hollow of press-down-jig 53 on each sloped part of positioning-jigs 52, and set the press-down-jig 53 on the face plate 15 (See FIG. 15B). Then, the cylindrical part of positioning-jig 52 is covered by the press-down-jig 53. And press down the top side of the face plate 15 by the press-down-jigs 52. An adhesive resin is applied on bottom of a face plate 15, and then the face plate 15 is stuck on the female-die 21 by the adhesive resin.

Figure 16:
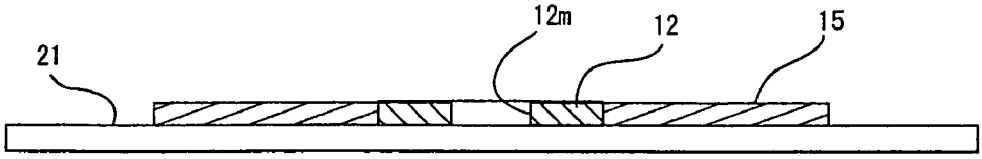
FIG. 16 is a side section view showing of a step of the face plate mounting procedure used the positioning-jig as above the Embodiment 2.

Next, pick the press-down-jig 53 up and remove, and then pick the positioning-jigs 52 up and remove (See FIG. 16). According to the embodiment 2, the face plate 15 has two through-holes 20 at a given interval, and the multiple through-holes 20 are set around the marking-members 12 that through-holes 20 are one-to-one correspond to the marking-members 12. The diameter of marking-member 12 is same as diameter of the through-hole 20 (See FIG. 16). Thus, there is no gap between the marking-members 12 and the through-holes 20.

According to the described embodiment, wherein a micro-depressions as micro-suckers are formed on bottom side of the face plate 15 preferably; and press down the top side of the face plate 15 and attaches the female-die 21, and push the face plate by given pressure which is air deflated the micro-depressions and the micro-suckers functions by negative pressure, and stick the face plate 15 with the female-die 21. Mean diameter of the micro-suckers are 5 to 300 micro meters. Thus, if not push the face plate 15 on the female-die 21, the face plate 15 doesn't stick on the female-die 21. Therefore, it can be check the face plate 15 position that the face plate 15 attached the female-die 21, and push the face plate 15 by given pressure and stick the face plate 15 plane-to-plane with the female-die 21 accurately. According to the micro-depressions as micro-suckers, the seat which comprises the micro-suckers is adhered on bottom side of the marking-members 12 preferably. Thus, the marking-members 12 can be stick on the female-die 21 and the marking-members 12 can be off the female-die 21 repeatable.

According to the described embodiment, an adhesive layer by splayed resin is formed on bottom side of the face plate 15, for example. According to the adhesive layer forming method used above the played resin that comprising steps of splay the resin particles on bottom side of the face plate 15 that the particles spaces uniformity; and dry surface of the adhesive layer. Then, the face plate 15 can be stick on the female-die 21 and the face plate 15 can be off the female-die 21 repeatable.

According to the described embodiment, an adhesive layer by gelled resin is formed on bottom side of the face plate 15, for example. The adhesive layer is given thickness, and it can be elastic deformation correspond to the thickness. Thus, the adhesive layer can be deforming for horizontal. Then, the face plate 15 is adjustable to the place that between the face plate 15 and the female-die 21. The gelled resin apply to a part of bottom side of the face plate 15, or the gelled resin apply to full of bottom side of the face plate 15. The face plate 15 is adjustable to the place about 0.1 to 0.2 mm.

According to the described embodiment, an adhesive layer by reusable resin is formed on bottom side of the face plate 15, for example. The face plate 15 can be stick on the female-die 21 and the face plate 15 can be off the female-die 21 repeatable.

What is claimed is:

1. A positioning-jig for adjusting a face plate on a female-die that forms a stamping machine together with a male-die opposite to the female-die, the male-die having a metal-blade as a stamp-blade according to outline of a unfolded box body and a rule-blade according to a valley fold-line of the unfolded box body; and the face plate having a groove that accepts a projection according to a hill fold-line to be opposed to the valley fold-line, and two or more through-holes therein; and a marking-member stuck on the female-die by transferring from the male-die; and the positioning-jig being used on the female-die while the face plate adhered on the female-die guides the marking-members inside each of the through-holes;

wherein the positioning-jig has a bottom side inner diameter and a bottom side outer diameter, and has a symmetrical shape at a top side; wherein the bottom side inner diameter of the positioning-jig is larger than an outer diameter of the marking-member, and the bottom side outer diameter of the positioning-jig is same or slightly smaller than the through-holes.

2. The positioning-jig according to claim 1, wherein the positioning-jig comprises a hollow part on a bottom side, and a diameter of the hollow part is same as or slightly larger than the diameter of the marking-member, and a depth size of the hollow part is same as or slightly larger than a thickness size of the marking-member.

3. The positioning-jig according to claim 1, wherein the positioning-jig comprises a press-down-jig as an attachment to the positioning-jig; wherein the press-down-jig has a hollow symmetrical shape at the top side, and an inside diameter of the press-down-jig is slightly larger than the bottom side outer diameter of the positioning-jig.

* * * * *